US010508472B2

(12) United States Patent
Piantek

(10) Patent No.: US 10,508,472 B2
(45) Date of Patent: Dec. 17, 2019

(54) AUTOMATICALLY-EXTENDIBLE DEADBOLT LATCH ASSEMBLY

(71) Applicant: Sargent Manufacturing Company, New Haven, CT (US)

(72) Inventor: Ryan Piantek, New Haven, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 15/913,322

(22) Filed: Mar. 6, 2018

(65) Prior Publication Data

US 2018/0320414 A1 Nov. 8, 2018

Related U.S. Application Data

(60) Provisional application No. 62/579,395, filed on Oct. 31, 2017, provisional application No. 62/503,094, filed on May 8, 2017.

(51) Int. Cl.

| | |
|---|---|
| ***E05B 63/20*** | (2006.01) |
| ***E05B 13/00*** | (2006.01) |
| ***E05B 15/10*** | (2006.01) |
| ***E05C 1/00*** | (2006.01) |
| ***E05B 63/18*** | (2006.01) |
| ***E05C 1/04*** | (2006.01) |
| *E05B 15/04* | (2006.01) |

(52) U.S. Cl.

CPC ..... *E05B 63/202* (2013.01); *E05B 13/004* (2013.01); *E05B 15/10* (2013.01); *E05B 63/185* (2013.01); *E05C 1/002* (2013.01); *E05C 1/04* (2013.01); *E05B 2015/0406* (2013.01); *E05B 2063/207* (2013.01)

(58) Field of Classification Search

CPC ..... E05B 63/202; E05B 13/004; E05B 15/10; E05B 63/185; E05B 2015/0406; E05B 2063/207; E05B 63/14; E05B 63/18; E05C 1/04; E05C 1/002

USPC ..... 70/107–111, 150, 151 R, 151 A, 153, 70/467–471, 481–487, DIG. 6; 292/169, 292/169.13, 169.14

See application file for complete search history.

(56) References Cited

U.S. PATENT DOCUMENTS

| | | | | |
|---|---|---|---|---|
| 2,181,313 A | | 11/1939 | Blodgett | |
| 2,484,571 A | | 10/1949 | Jozefowicz | |
| 3,148,524 A | * | 9/1964 | Yulkowski | E05B 59/00 70/107 |

(Continued)

FOREIGN PATENT DOCUMENTS

| | | |
|---|---|---|
| AU | 2007219334 A1 | 4/2008 |
| WO | WO 2015/058252 A1 | 4/2015 |

OTHER PUBLICATIONS

International Search Report and Written Opinion for International Application No. PCT/US2018/031391, dated Aug. 9, 2018.

(Continued)

*Primary Examiner* — Lloyd A Gall

(74) *Attorney, Agent, or Firm* — Wolf, Greenfield & Sacks, P.C.

(57) ABSTRACT

A latch assembly for a door includes automatically deployable deadbolt. When the door is closed and the latch engages a strike plate, the deadbolt automatically extends into a corresponding opening in a door jamb to secure the door.

20 Claims, 13 Drawing Sheets

(56) References Cited

U.S. PATENT DOCUMENTS 4,389,061 A * 6/1983 Foshee ..... E05B 59/00 292/169.14
4,674,776 A * 6/1987 James ..... E05B 13/004 292/150
4,870,841 A 10/1989 Cudd
4,890,870 A 1/1990 Miron
4,950,005 A * 8/1990 Cudd ..... E05B 63/185 292/150
5,267,457 A 12/1993 Sorensen et al.
5,678,870 A * 10/1997 Pelletier ..... E05B 55/12 292/169.16
5,941,581 A 8/1999 Heithe
6,212,923 B1 4/2001 Clark
6,302,456 B1 * 10/2001 Errani ..... E05B 59/00 292/165
6,578,888 B1 6/2003 Fayngersh et al.
7,007,985 B2 3/2006 Alexander et al.
7,155,946 B2 * 1/2007 Lee ..... E05B 59/00 292/169.14
7,303,215 B2 * 12/2007 Moon ..... E05B 47/0673 292/169
7,431,354 B2 10/2008 Raatikainen
7,866,713 B2 * 1/2011 Chen ..... E05B 13/004 292/165
2002/0101083 A1 8/2002 Toledano et al.
2004/0045330 A1 3/2004 Moon et al.
2005/0046198 A1 * 3/2005 Alexander ..... E05B 59/00 292/163
2006/0123859 A1 6/2006 Gonzalez
2009/0151407 A1 6/2009 Lin
2009/0151408 A1 6/2009 Petry
2012/0167646 A1 7/2012 Sharma et al.
2016/0189503 A1 6/2016 Johnson et al.
2017/0228603 A1 8/2017 Johnson
2017/0362856 A1 12/2017 Almomani et al.
2018/0298640 A1 10/2018 Caterino
2019/0178005 A1 6/2019 Caterino et al.

OTHER PUBLICATIONS

Invitation to Pay Additional Fees for International Application No. PCT/US2018/028066, dated Jun. 27, 2018.
International Search Report and Written Opinion for International Application No. PCT/US2018/028066, dated Aug. 29, 2018.
International Search Report and Written Opinion for International Application No. PCT/US2018/062738, dated Feb. 11, 2019.

* cited by examiner

AUTOMATICALLY-EXTENDIBLE DEADBOLT LATCH ASSEMBLY

RELATED APPLICATIONS

This application claims the benefit under 35 U.S.C. § 119(e) to U.S. Provisional Application Ser. No. 62/503,094, titled "AUTOMATICALLY-EXTENDIBLE DEADBOLT LATCH ASSEMBLY", filed on May 8, 2017 and to U.S. Provisional Application Ser. No. 62/579,395, titled "AUTOMATICALLY-EXTENDIBLE DEADBOLT LATCH ASSEMBLY", filed on Oct. 31, 2017, each of which is incorporated herein in its entirety.

FIELD

Disclosed embodiments are related to an automatic deadbolt engagement feature for a door lock.

BACKGROUND

Conventionally, a deadbolt is engaged or disengaged by a user or operator turning a knob (when operating the door from the "inside") or using a key (when operating the door from the "outside"). A would-be intruder cannot disengage the deadbolt from the outside except by use of the proper key. This is in contrast to a spring bolt lock, which allows the lock to retract by applying force to the bolt itself. A deadbolt therefore is often used to provide additional security, making unauthorized entry more difficult. However, in conventional systems, a deadbolt is only engaged when the user or operator performs the additional step of manually engaging the deadbolt, whether by knob or key.

Accordingly, there is a need for improvements in locks that engage the deadlock automatically, thereby improving security of the door latch assembly.

SUMMARY

According to a first aspect, a latch assembly for a door is provided. The mortise lock includes a chassis; and a latch bolt supported by the chassis and configured to move relative to the chassis between a retracted latch position and an extended latch position. The latch assembly also includes an auxiliary bolt supported by the chassis and configured to move relative to the chassis between a retracted auxiliary position and an extended auxiliary position. The latch assembly also includes a deadbolt supported by the chassis and configured to move relative to the chassis between a retracted deadbolt position and an extended deadbolt position. The deadbolt includes a lower deadbolt leg having a catch. The mortise lock also includes a guard lever having a free position and a secure position. When the auxiliary bolt is in the extended auxiliary position the guard lever is in the free position allowing the latch bolt to move between the extended latch position and retracted latch position, and when both the auxiliary bolt is in the retracted auxiliary position and the latch bolt is in the extended latch position, the guard lever is in the secure position preventing movement of the latch bolt to the retracted latch position. The latch assembly also includes a sear connected to a top of the guard lever, the sear being configured to engage with the catch of the lower deadbolt leg when the guard lever is in the secure position, thereby maintaining the deadbolt in the retracted deadbolt position, and the sear being configured to release from the catch of the lower deadbolt leg when the guard lever is in the free position, thereby permitting the deadbolt to move to the extended deadbolt position.

According to a second aspect, a door system is provided. The door system includes a door and a mortise lock coupled to the door. The door system also includes first and second handles coupled to the door and to the mortise lock and operable to open said door. The door system also includes a key system coupled to said door and to said mortise lock. The mortise lock also includes a latch assembly of exemplary embodiments.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
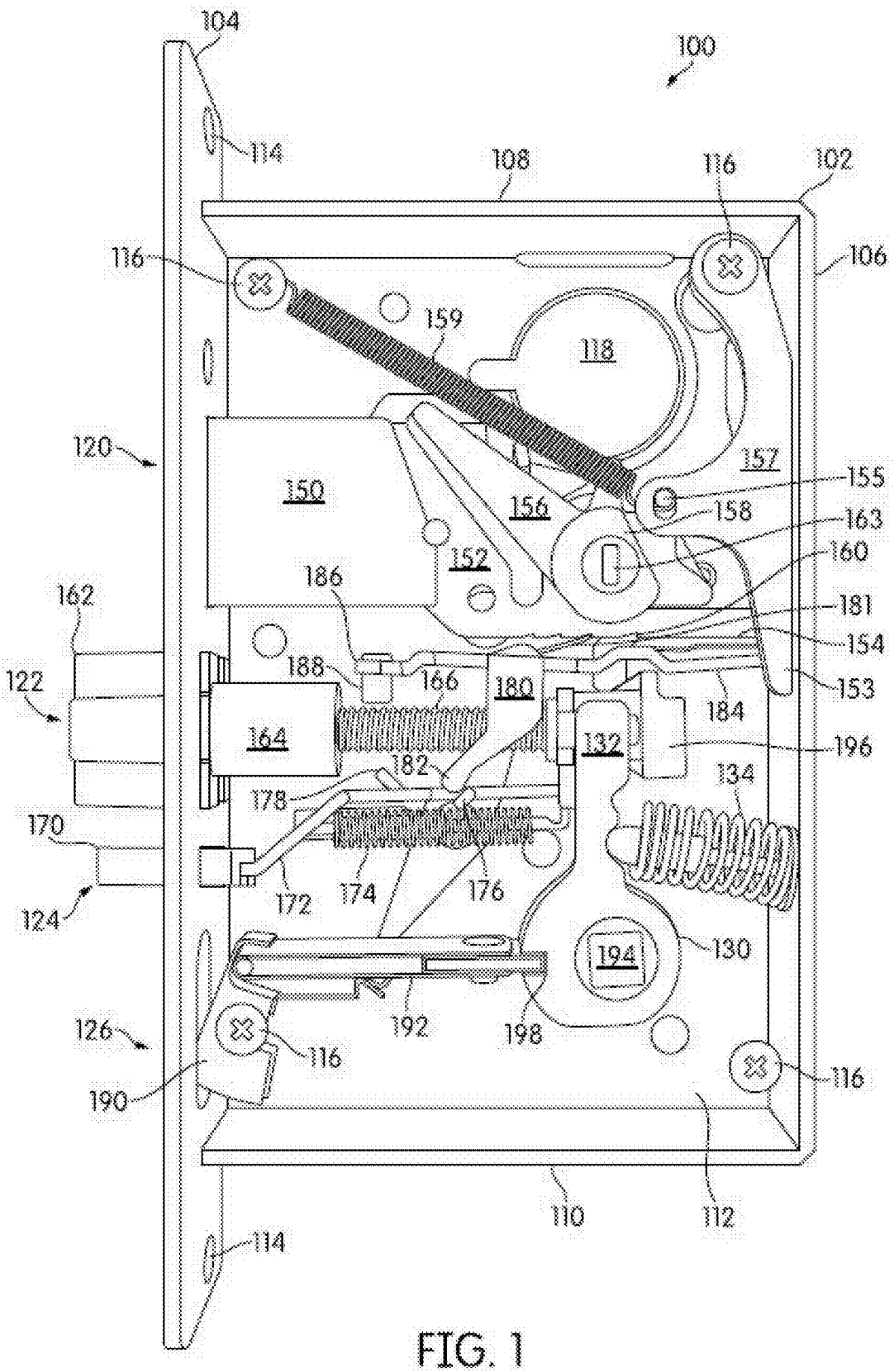
FIG. 1 illustrates a side perspective view of a latch assembly according to one embodiment.

The present disclosure relates to an automatic latch assembly that deploys a deadbolt or other securing device upon closing a door and a method of using thereof. The automatic latch assembly may be used to increase the security of a door by automatically releasing a biased deadbolt to fasten the door while still allowing simple authorized access. In this way, a door can be more consistently secured from unauthorized persons or inclement weather.

According to one aspect, the latch assembly may include a deadbolt mechanism that cooperates with a latch bolt and an auxiliary bolt to automatically move the deadbolt to an extended deadbolt position. The latch assembly may be installed on a door to automatically engage the deadbolt with a door jamb when the door is closed. The deadbolt mechanism may include a deadbolt biasing member (e.g., a spring) that urges a deadbolt to the extended (i.e., locked) position. The deadbolt assembly may further include a catch configured to engage a sear controlled by the auxiliary bolt. The sear may be constructed to hold the deadbolt in place when the door is not closed by resisting force from the deadbolt biasing member. The deadbolt mechanism may also include a slide mechanism arranged to allow a turning motion of a deadbolt handle to extend or retract the deadbolt. The slide mechanism may also be configured to prevent the retraction of the deadbolt without a corresponding turning of the deadbolt handle. In some embodiments, the deadbolt mechanism may further include a deadlocking tab constructed and arranged to prevent the latch bolt from retracting when the deadbolt is in the extended deadbolt position, or alternatively, prevent the deadbolt from extending with the latch bolt is in a retracted latch position. In some embodiments, the deadbolt mechanism may be configured to be actuated by a door handle coupled to the latch bolt, such that the door can be operated traditionally by a single handle. According to this embodiment, the automatic deadbolt would increase door security while avoiding any additional steps for operation.

According to another aspect, the latch assembly may include a latch bolt that cooperates with the deadbolt mechanism and the auxiliary bolt to move the deadbolt to the extended deadbolt position at the correct time to prevent jams or damage to a door frame. The latch bolt may include a latch bolt head with an inclined face constructed and arranged to strike a door frame as the door is closed, thereby causing the latch bolt to be retracted. The latch bolt may further include an latch biasing member arranged to urge the latch bolt toward an extended latch position. In some embodiments, the latch bolt may include an end constructed and arranged to actuate the deadbolt to a retracted position when a door handle coupled to the end of the latch bolt is turned. According to this embodiment, the movement of the latch bolt head may be decoupled from the movement of the end that actuates the deadbolt, thereby preventing retraction of the deadbolt from external force applied on the latch bolt head. In some embodiments, the latch bolt head may be prevented from retracting with the deadbolt is in the extended position (i.e., deadlocking). Additionally, such an arrangement may prevent the deadbolt from extending if the latch bolt head is not correspondingly extended and therefore prevent jamming and improve reliability of the latch assembly. Accordingly, the deadbolt extends only if door was aligned enough such that the latch bolt was extended into a pocket on a door frame, thereby preventing the deadbolt from impacting the door frame and possibly causing a jam.

According to another aspect, the latch assembly may include an auxiliary bolt that cooperates with the deadbolt and the latch bolt to automatically trigger the deadbolt to move into the extended position. The auxiliary bolt may be connected to an auxiliary biasing member that urges the auxiliary bolt to an extended auxiliary position. The auxiliary bolt may further include an auxiliary bolt head with an inclined face configured to retract the auxiliary bolt when the auxiliary bolt head strikes a door frame. The auxiliary bolt may include one or more tabs located on an auxiliary arm arranged to contact a guard lever. In some embodiments, the guard lever is moveable by the auxiliary bolt and includes a sear constructed and arranged to contact a catch on the deadbolt mechanism. The guard lever may be moved between a secure position and a free position by the one or more tabs or auxiliary arm on the auxiliary bolt as the auxiliary bolt is correspondingly retracted or extended. In the free position, the sear may contact and engage the catch on the deadbolt mechanism to resist urging force from the deadbolt biasing member and thereby prevent the deadbolt from being extended. In the secure position, the guard lever may be moved to a position where the sear is released from the catch, thereby releasing the deadbolt mechanism and allowing the deadbolt to automatically extend from the urging force received from the deadbolt biasing member. According to the present embodiment, the auxiliary bolt may prevent the deadbolt from moving to the extended position when the auxiliary bolt is in an extended position. When the auxiliary bolt is retracted the one or more tabs may force the guard lever to the secure position to release the sear from the catch which allows the deadbolt to extend. Such an arrangement may prevent an extension of the deadbolt that may otherwise cause jams or prevent damage to a door frame by releasing the deadbolt mechanism only when auxiliary bolt strikes a door frame and is sufficiently retracted.

In some embodiments, the latch assembly may include a lock switch configured to lock the operation of an attached door handle. For example, the latch assembly may include a lock switch constructed and configured to selectively move a lock switch arm into a locked switch position or an unlocked switch position. In the locked position, the lock switch arm may engage a notch or other suitable structure on a door lever hub arranged to receive and mount a door handle, thereby preventing the rotation of the door handle and lever hub. In the unlocked switch position, the lock switch arm may be removed from the notch or other suitable structure to allow free rotation of the door handle and lever hub. In some embodiments, the lock switch may only prevent rotation of the lever hub and door handle from one side (e.g., exterior side of the door). Such an arrangement may be beneficial to increase the security of the door by preventing manipulation of the door handle from outside of the secured space. In some cases, it may be beneficial to bypass the lock switch if a user has the appropriate credentials (e.g., a key). Accordingly, the lock switch may be moved to the unlocked switch position or otherwise removed from engaging the lever hub to permit the rotation thereof by the deadbolt mechanism. Such an arrangement may allow a user with appropriate credentials (e.g., a key) to move the lock switch to the unlocked switch position from the exterior side of the door, thereby allowing the user to turn the door handle from said exterior side to open the door.

Now turning to the figures, FIG. 1 depicts latch assembly 100 which in this example is embodied in a mortise lock for a door including a chassis or housing 102 having front plate 104, rear plate 106, top plate 108, bottom plate 110, and side plates 112 (one side plate is omitted from FIG. 1 to expose internal components of the latch assembly 100). Front plate 104 may have holes 114 through which screws or bolts may be used for securing or fastening the latch assembly 100 to a door. For example, there may be two holes, one at a top of front plate 104 and another at a bottom of front plate 104, or there may be more or fewer holes. Other suitable devices for securing or fastening the latch assembly 100 to a door may also be used as the disclosure is not limited in this respect. Front plate 104 further includes openings for one or more of deadbolt mechanism 120, latch bolt 122, auxiliary bolt 124, and lock switch 126. Chassis 102 may be secured together by screws 116 passing through side plates 112. For example, four screws, one at each corner of side plates 112, may be used, or more or fewer screws or other fastening devices or methods in other suitable arrangements. Chassis 102 may be formed out of one or more pieces. For example, in some embodiments, rear plate 106, top plate 108, bottom plate 110, and one of side plates 112 may be formed as a single integral piece of material (e.g., metal, plastic, or some other material or combination of materials) that is secured or fastened to front plate 104 or the opposing one of side plates 112 or both by, e.g., screws, bolts, rivets, snap or press fit, welding, or some other fastening device or method or combination of fastening devices or methods. In some embodiments, chassis 102 may include one or more slots in either or both of side plates 112 to facilitate moving or sliding pieces inside of the latch assembly (see, for example, FIG. 12C). Chassis 102 may also include a hole or space 118 to receive a lock mechanism, such as a key-operated cylinder lock, an electromechanical lock, etc.

Figure 2A:
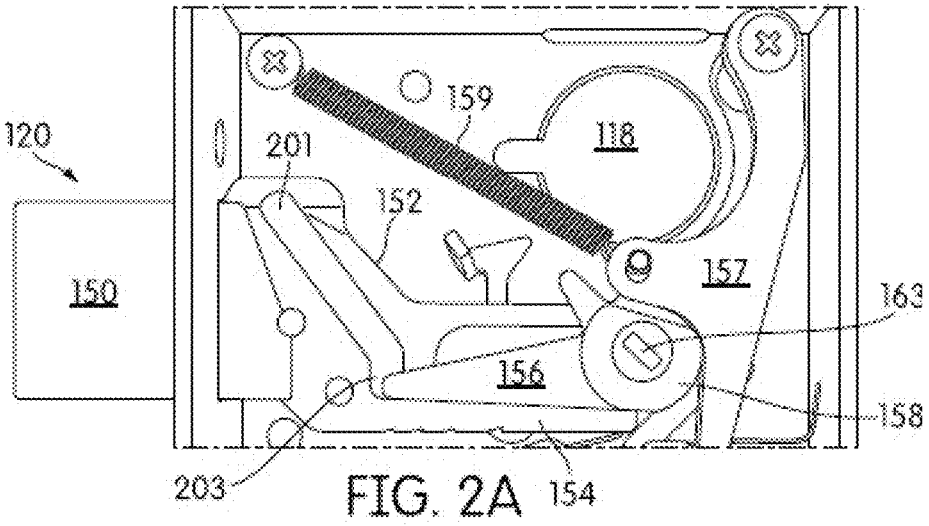
FIGS. 2A-2C illustrate detailed views of a deadbolt within the latch assembly of FIG. 1.

Deadbolt mechanism 120 includes deadbolt head 150, a deadbolt arm 156, and a deadbolt backstop 157. Deadbolt head 150 protrudes from chassis 102 and front plate 104 when deadbolt mechanism 120 is in the extended deadbolt position and is within or substantially within a profile of the chassis 102 when deadbolt mechanism 120 is in the retracted deadbolt position. In some embodiments, deadbolt head 150 is a solid piece of metal. Deadbolt mechanism 120 also includes a slide mechanism 152 extending from the deadbolt head 150 and including one or more slots. Slide mechanism 152 includes one or more slots (e.g., cam slot 201 shown in FIGS. 2A-2C) and lower deadbolt leg 154. Deadbolt mechanism 120 also includes deadbolt arm 156 rotatably mounted within the chassis 102. Deadbolt arm 156 has a protrusion that extends (into the page) into the cam slot 201 of slide mechanism 152 and a thumb turn 158 having a slot 163 about which the deadbolt arm 156 rotates. When thumb turn 158 is turned, for example by a user operating a knob or key engaging the thumb turn slot, the protrusion of deadbolt arm 156 contacts an edge cam slot 201 in the slide mechanism 152 in a camming fashion and causes the deadbolt mechanism 120 to move relative to the chassis 102 between a retracted position and an extended position (see FIGS. 2A-2C). In one embodiment, the cam slot 201 in the slide mechanism 152 is angled at a lower slot 203 thereof such that, when the deadbolt mechanism 120 is in the extended position (as shown in FIG. 2A), the deadbolt mechanism 120 is prevented from moving relative to the chassis 102 as the deadbolt arm 156 is aligned with the deadbolt head 150 and a retracting force on the deadbolt head will simply cause the lower slot 203 of the slot 201 to bear against the protrusion of the deadbolt arm 156 without rotating the deadbolt arm.

Lower deadbolt leg 154 may include one or more catches 160 (e.g. serrations, ratchets, teeth, cutouts) formed on a lower edge thereof. In some embodiments, the one or more catches 160 may be arranged to engage a portion of a sear or other suitable projection on an engagement side of the catch, thereby preventing the deadbolt head 150 from extending. In some embodiments, the sear may be constructed and arranged to flex out of the way of the lower deadbolt leg 154 when the deadbolt mechanism 120 moves toward the retracted deadbolt position. In other embodiments, the sear is constructed rigidly so that the sear remains stationary relative to the guard lever as the deadbolt mechanism 120 moves toward the retracted deadbolt position, as the present disclosure is not so limited. The one or more catches 160 may be arranged to allow the sear or other suitable projection to slide past when the deadbolt head 150 is retracted. In one such arrangement, the one or more catches 160 may be configured to allow the deadbolt head 150 to retract unimpeded regardless of the position of the sear or other suitable projection, but may prevent the deadbolt head 150 from extending without a corresponding action to move and release the sear.

Deadbolt arm 156 is coupled to a deadbolt backstop 157 by a peg 155 on deadbolt arm 156 which is inserted through an opening or hole in backstop 157. Backstop 157 is configured to pivot about the screw 116 in the upper, right-hand side of the chassis 102. A deadbolt biasing member 159 is coupled to deadbolt backstop 157 (e.g., by being connected to the peg 155). The deadbolt biasing member 159 is configured as an extension spring biased such that it tends to pull backstop 157, which results in arm 156 engaging the slide mechanism 152 and ultimately causes deadbolt mechanism 120 to move the deadbolt head 150 relative to the chassis 102 between a retracted deadbolt position and an extended deadbolt position. While in the present embodiment an extension spring is depicted, any suitable biasing member may be employed, including but not limited to a compression spring or torsion spring. In the arrangement shown, the deadbolt biasing member 159 is prevented from causing the deadbolt mechanism toward an extended deadbolt position by a sear 181 engaged in a catch 160 on lower deadbolt leg 154, which prevents the deadbolt head 150 from moving relative to the chassis between a retracted deadbolt position and an extended deadbolt position. This is described further below.

Latch bolt 122 includes latch bolt head 162 and latch bolt cylinder 164. Latch bolt head 162 protrudes from chassis 102 and front plate 104 when latch bolt 122 is in the extended position and is within or substantially within a profile of the chassis 102 when latch bolt 122 is in the retracted position. A latch biasing member 166 is surrounds a rod extending from the cylinder 164 and urges the latch bolt 122 to remain in the extended latch position.

A guard lever 180 includes a guard lever lower leg 182 and a guard lever arm 184. In some embodiments, guard lever 180 is supported in chassis 102 by an end of lever arm 184 being attached to rear plate 106. Guard lever 180 pivots relative to chassis 102 about the end of the guard lever supported in the rear plate 106, between an upper or free position (see FIG. 4A) and a lower or secure position (see FIG. 4B). In some embodiments, the pivoting movement is controlled and limited by an extension of the guard lever near stopping end 186 extending laterally into a slot 188 formed in one or both of side plates 112. When guard lever 180 is in its secure position, stopping end 186 of guard lever arm 184 acts to prevent latch bolt 122 from moving to its retracted position by contacting the latch bolt cylinder 164 and thereby blocking further retraction of the latch bolt 122 (see FIG. 4B).

In some embodiments, the guard lever arm 184 may include a guard biasing member (not shown in the figure) that urges the guard lever arm 184 toward either the secure or the free position. In one such arrangement, the guard lever arm 184 may include a spring that biases the guard member toward the secure position. In this embodiment, the first tab may prevent the downward movement of the guard lever arm 184 (i.e., toward the secure position) by engaging the guard lever 180 and forcing the guard lever arm 184 up (i.e., toward the free position). Accordingly, when the auxiliary bolt 124 retracts and the first tab 176 disengages with the guard lever arm 180, the guard lever arm 184 may be urged by the guard biasing member to the secure position, thereby releasing the sear 181 and allowing deadbolt mechanism 120 to extend. In another embodiment, the guard lever arm 184 may be urged upwards by the guard biasing member toward the free position, and the auxiliary arm 172 may be constructed and configured to engage the guard lever lower leg 182 and move the guard leg down (i.e., toward the secure position) when the auxiliary bolt is retracted. While some embodiments of the latch assembly 100 include a guard biasing member, it can be appreciated that any suitable arrangement whereby the guard lever may be moved between a free and a secure position may be employed.

Figure 4A:
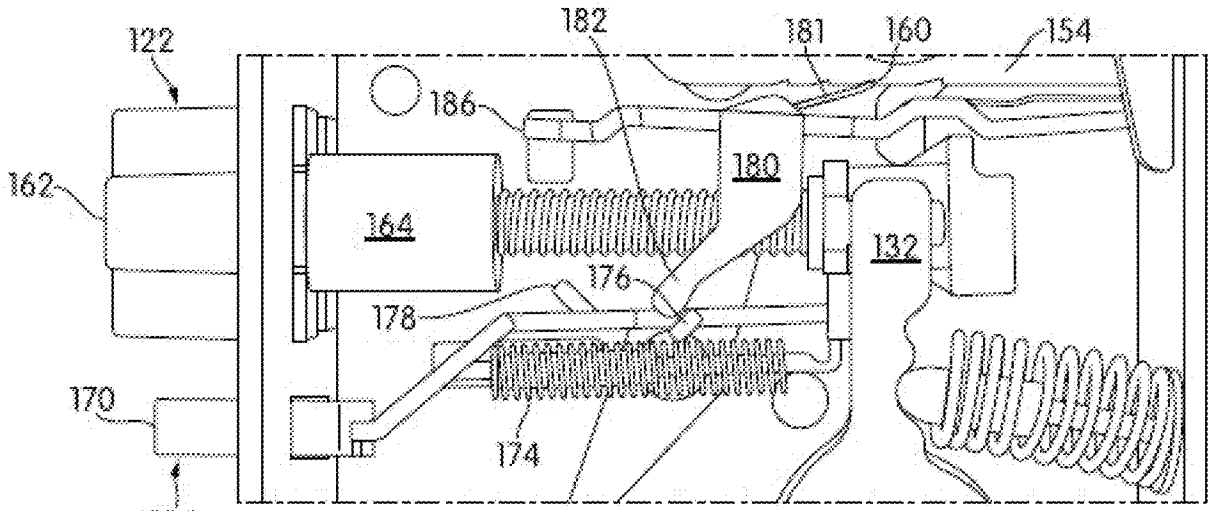
FIGS. 4A-4B illustrate detailed views of an auxiliary bolt within the latch assembly of FIG. 1.

As shown in FIG. 1, the sear 181 projects upwardly from the guard lever 180 and is configured to engage one of the catches 160 on lower deadbolt leg 154 when guard lever 180 is in its free position, as shown in FIGS. 1 and 4A, to prevent the deadbolt head 150 from moving to the extended position. Because of the angle of the catches 160, the sear 181 does not prevent the deadbolt head 150 from moving from the extended deadbolt position to the retracted deadbolt position. As shown in FIG. 1, the sear may be flexible, such that it can flex over the catches to allow easier retraction of the deadbolt head 150 while still preventing the extension of the deadbolt head 150 when the guard lever is in the free position. In some other embodiments, the sear may be constructed and configured as a rigid tab extending from the guard lever arm 184. When guard lever 180 moves to its secure position (see FIG. 4B), sear 181 becomes disengaged from the catch 160, which allows deadbolt mechanism 120 to move to its extended position. That is, the disengagement of sear 181 from the catches 160 on lower deadbolt leg 154, allows deadbolt biasing member 159 to move deadbolt backstop 157 and deadbolt arm 156, causing the protrusion on deadbolt arm 156 engaged with the slide mechanism 152 to move deadbolt head 150 to its extended position.

Figure 4B:
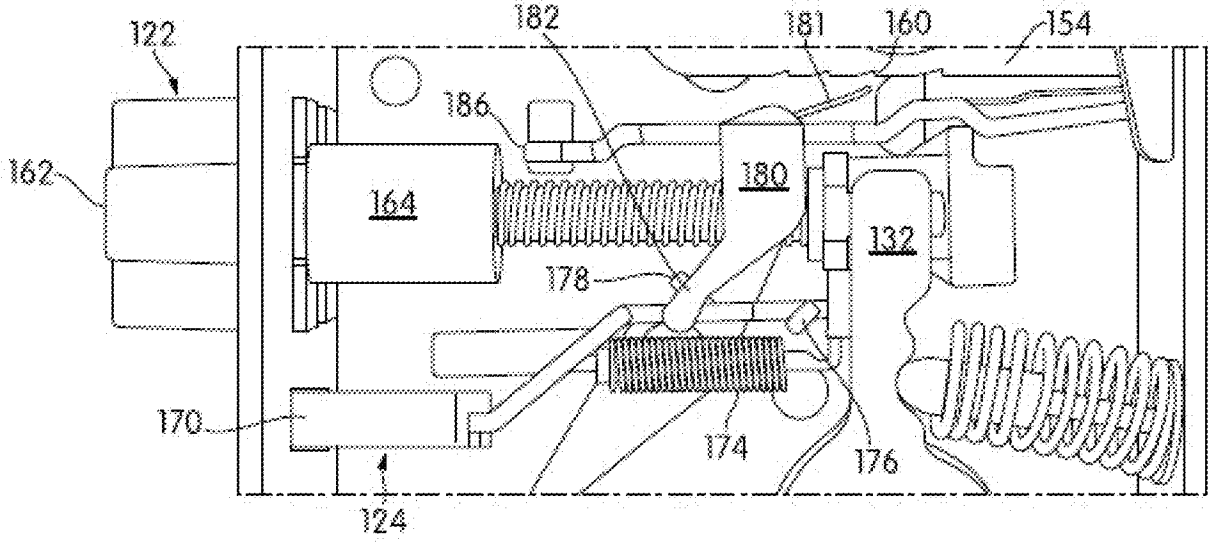

Auxiliary bolt 124 includes tongue 170 and auxiliary arm 172. Auxiliary bolt tongue 170 protrudes from chassis 102 and front plate 104 when auxiliary bolt 124 is in the extended auxiliary position and is within or substantially within a profile of the chassis 102 when auxiliary bolt 124 is in the retracted auxiliary position. Auxiliary bolt spring 174 is coupled with arm 172 and urges the auxiliary bolt 124 to remain in the extended position. Auxiliary bolt arm 172 includes a first tab 176 and a second tab 178. As shown in FIGS. 1 and 4A, when auxiliary bolt 124 is in the extended position, the first tab 176 acts to prop up guard lever 180 by engaging its lower leg 182 to maintain guard lever 180 in its free position (allowing latch bolt 122 to move freely between its extended and retracted positions). As shown in FIG. 4B, when auxiliary bolt 124 is retracted, the first tab 176 is disengaged from lower leg 182 and the auxiliary arm 172 and/or second tab 178 engage lower leg 182, thereby moving the guard lever 180 to its secure position blocking latch bolt 122 from moving to its retracted position. In some embodiments, when latch bolt 122 is moved to its retracted position, latch bolt cylinder 164 makes contact with the second tab 178 of auxiliary bolt arm 172, causing auxiliary bolt 124 to also move to its retracted position.

As shown in FIG. 1, the latch assembly 100 may include a lever hub 130 with two aligned latch arms 132 coupled to the latch bolt 122, a lever spring 134, and two aligned holes 194. For example, a square shaft of a door handle may be inserted into each of the holes 194, such as an inside door handle and an outside door handle in each respective hole 194. The latch arms 132 are configured to move independently as the lever hub 130 rotates about an axis defined by the center of holes 194 between an open and a closed position, with lever spring 134 biasing them to their closed position as shown in FIG. 1. When the door handle inserted into the hold 194 rotates it will cause the corresponding latch arm 132 to move to its open position, engaging a contact at an end 196 of the rod extending from the latch bolt cylinder 164, thereby causing latch bolt 122 to move to its retracted position.

In some embodiments, the deadbolt mechanism 120 is coupled to the latch bolt 122 and the lever hub 130 so that if deadbolt mechanism 120 is in its extended position, moving a latch arm 132 to its open position will additionally cause deadbolt mechanism 120 to move to its retracted position. In particular, a lower extending leg 153 of the deadbolt backstop 157 contacts the latch bolt end 196 located at the end of the rod extending from the latch bolt cylinder 164 when the deadbolt mechanism 120 is in the extended position (see FIG. 4A). When a latch arm 132 is rotated (e.g., via a door handle coupled to the opening 194), the contact 196 is moved, which contacts the lower leg 153 and pivots the deadbolt backstop 157, which rotates the deadbolt arm 156 so as to retract the deadbolt head 150.

As shown in FIG. 1, the latch assembly 100 may include a lock switch mechanism 126 which further includes a switch (e.g., a rocker switch) 190 and a lock switch arm 192. Lock switch 126 has a locked position and an open position. In some embodiments, lever hub 130 includes a notch 198 that is engaged by lock switch arm 192 when lock switch 126 is in its locked position, as shown in FIGS. 1 and 3A. In these embodiments, at least one of the one or more levers 132 will be prevented from moving. For example, none of the door handles attached to hole 194 will be able to open the door, or in some embodiments, only the exterior door handle will be prevented from opening the door while the interior door handle remains unaffected. According to these embodiments, when lock switch 126 moves to its open position, lock switch arm 192 disengages from notch 198 (see FIGS. 3B-3D), thereby allowing the latch arms 132 to move. In some embodiments, the latch bolt mechanism 120 is coupled to the lock switch mechanism 126 so that when deadbolt 156 is moved to its extended position, lock switch 126 and lock switch rocker 190 are placed in their respective locked positions.

Figure 2B:
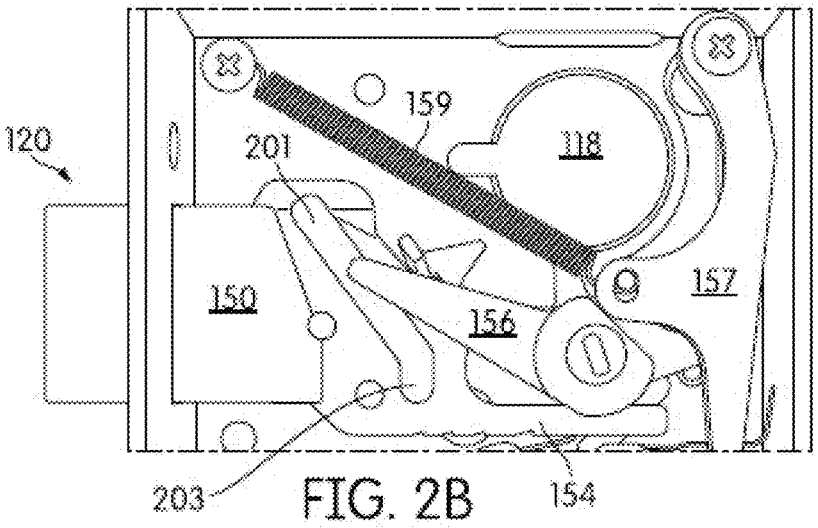
Figure 2C:
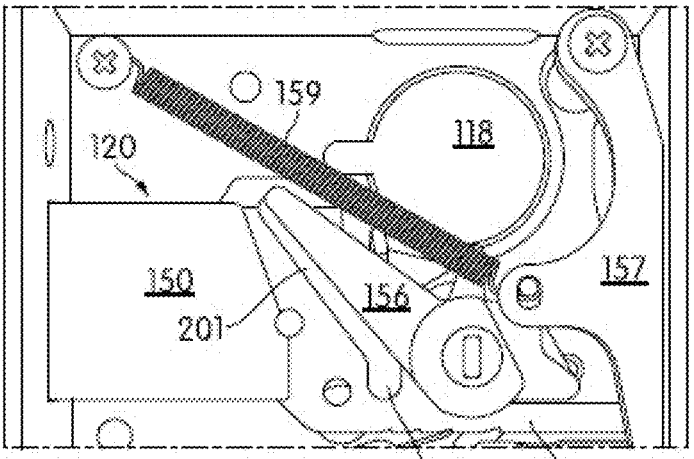

FIGS. 2A-2C further illustrate operation of the deadbolt mechanism 120 to move the deadbolt head 150 relative to the chassis between an extended and a retracted position. In FIG. 2A, the deadbolt head 150 is fully extended and deadbolt arm 156 is rotated to an aligned orientation with respect to the deadbolt head 150 and engaged with the lower slot 203 of the sliding mechanism 152. In FIG. 2B, the deadbolt head 150 is in a midway position between fully extended and fully retracted as the deadbolt arm is rotated to engage the obliquely-angled portion of the cam slot 201. In FIG. 2C, the deadbolt is fully retracted as the deadbolt arm has been fully rotated to engage the top end of the obliquely-angled portion of the cam slot 201. The interaction between the slide mechanism 152 and the deadbolt arm 156 is also shown. For example, as the deadbolt moves from a retracted to an extended position, the arm 156 moves along the angled portion of the cam slot 201 in the slide mechanism 152. As shown in FIG. 2A, when in the deadbolt head 150 is in extended position, the protrusion of arm 156 is at a position in the lower slot 203 of the cam slot 201 such that an inward force applied to deadbolt head 150 will not result in the protrusion of arm 156 moving along slot 201, thereby preventing such force from causing the deadbolt head 150 to move to a retracted position.

Figure 3B:
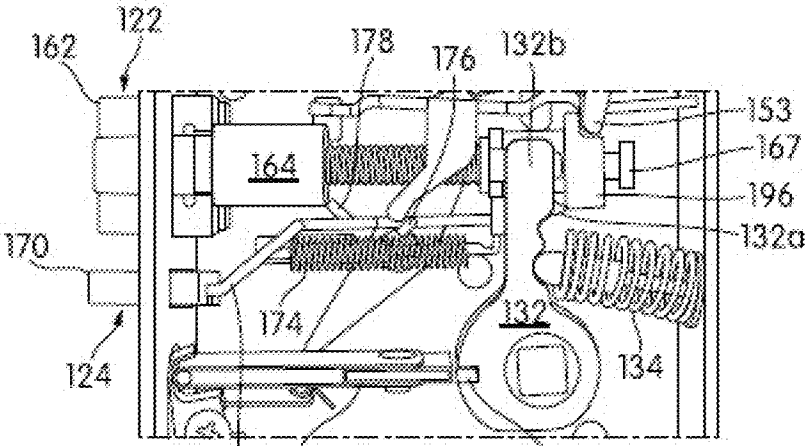
FIGS. 3A-3D illustrate detailed views of a latch bolt within the latch assembly of FIG. 1.
Figure 3D:
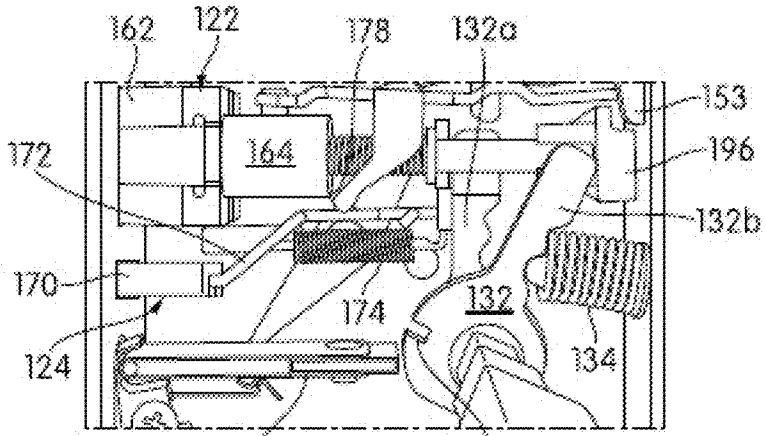
Figure 3A:
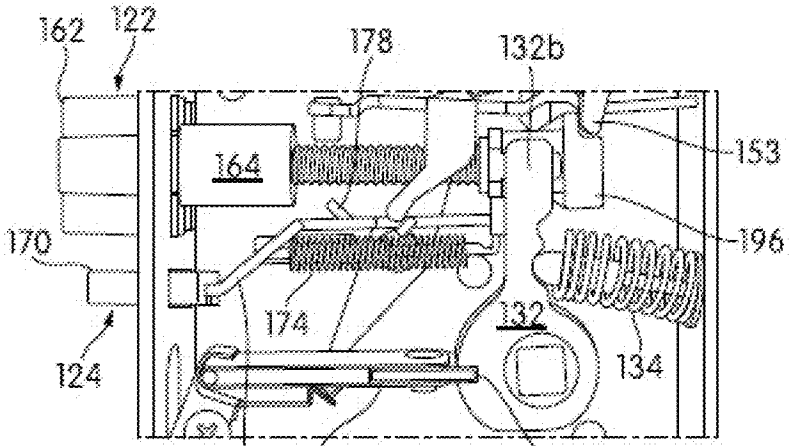
Figure 3C:
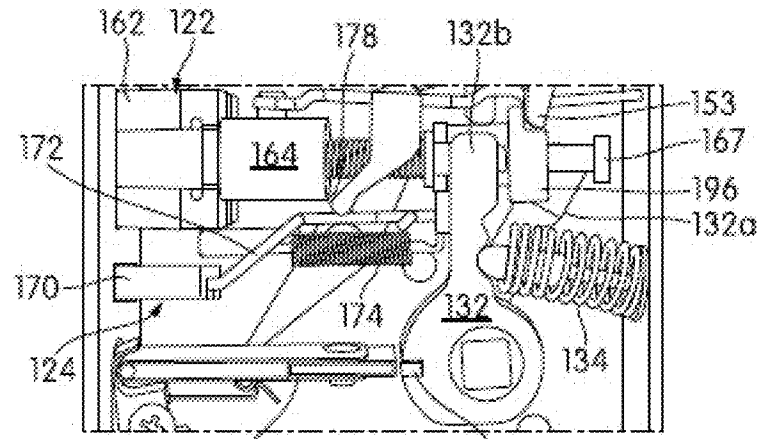

FIGS. 3A-3D depict the various positions of lock switch 192 and lever hub 130 of the embodiment shown in FIG. 1. In FIG. 3A, latch bolt 122 is fully extended and latch arms 132 (including inside latch arm 132*a* and outside latch arm 132*b*) are each in their respective closed positions. In FIG. 3B, the latch bolt 122 is moved independently of the latch arms 132 against the bias of spring 166 (for example as the door is being closed and the latch bolt head 162 contacts the strike of the door frame) and is shown in a midway position between fully extended and fully retracted. Note that contact 196 and lower leg 153 remain stationary in contact with the latch arms 132, as a head 167 at the end of the rod extending from the latch bolt cylinder 164 extends through the contact 196 as the latch bolt 122 retracts. The latch bolt cylinder 164 has made initial contact with second tab 178 of the auxiliary bolt arm 172. In FIG. 3C, the latch bolt 122 is fully retracted as is the auxiliary bolt 124, again, independently of any movement of the latch arms 132. FIG. 3D shows the latch bolt 122 fully retracted, as actuated by the outside lever 132*b* which is rotated to its open position (while inside lever 132*a* remains in its closed position) and contacting the end 196 of the rod extending from the latch bolt cylinder 164, thereby causing latch bolt 122 to move to its retracted position.

FIGS. 4A-4B further illustrate movement of the auxiliary bolt 124 relative to the chassis between an extended and a retracted position. In FIG. 4A, the latch bolt 122 and the auxiliary bolt 124 are fully extended. Guard lever 180 is in its free position as first tab 176 contacts lower leg 182. With the guard lever 180 in its free (raised) position, sear 181 engages a catch 160 on lower deadbolt leg 154, thereby preventing extension of the deadbolt head 150. In FIG. 4B, the auxiliary bolt 124 is fully retracted while the latch bolt 122 is still fully extended. This is the condition when the door is fully closed, the latch head 162 of the latch bolt 122 extends under the force of spring 166 into a latch pocket in the door frame but no pocket is provided in the door frame for the tongue 170 of the auxiliary bolt 124, and thus the auxiliary bolt 124 does not extend. With latch bolt 122 extended and the auxiliary bolt 124 not extended, the guard lever 180 is in its secure position, with sear 181 disengaged from catch 160 on lower deadbolt leg 154. With the sear 181 disengaged from the catch 160, the deadbolt head 150 is able to automatically extend by action of the deadbolt spring 159 acting on the deadbolt backstop 157, which, in turn, due to the coupling of the deadbolt backstop 157 to the deadbolt arm 156 by the peg 155, causes the deadbolt arm 156 to rotate and thereby extend the deadbolt head 150. Thus, when the door is closed, the deadbolt automatically extends into the locked position.

Figure 5A:
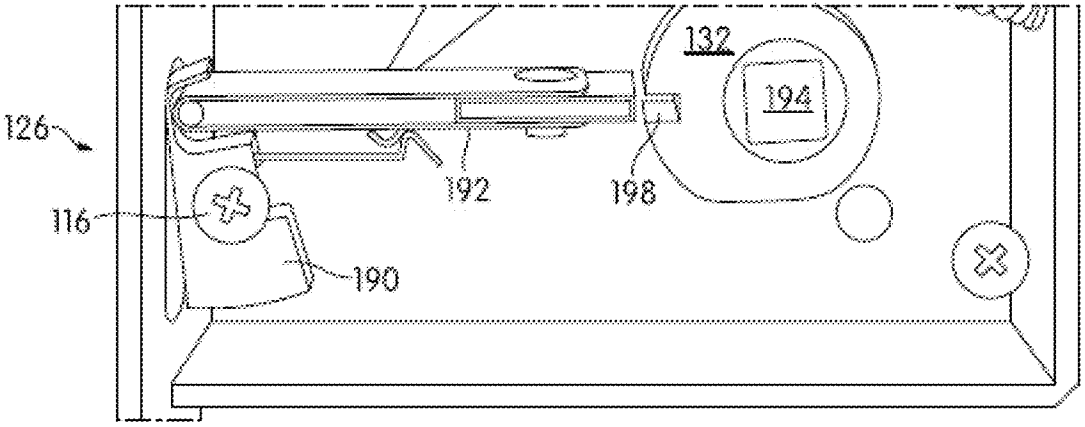
FIGS. 5A-5B illustrate detailed views of a lock switch within the latch assembly of FIG. 1.
Figure 5B:
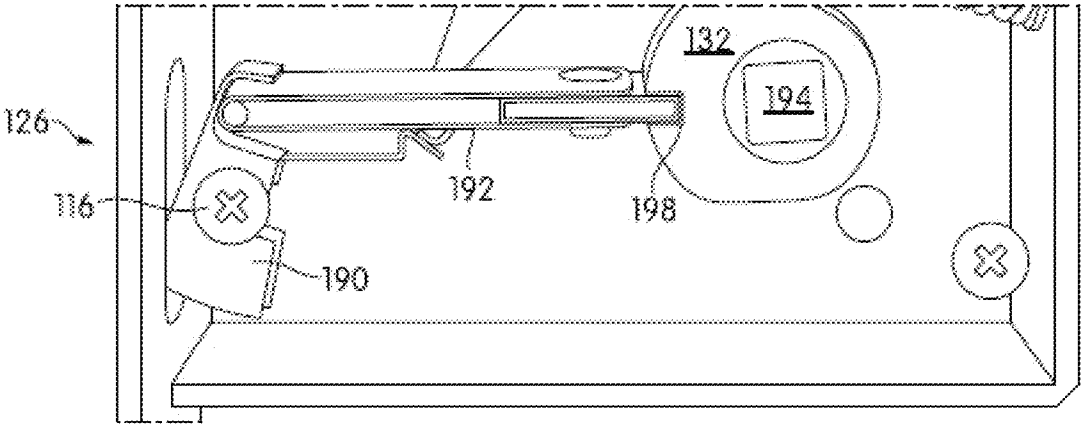

FIGS. 5A-5B further illustrate movement of the lock switch mechanism 126 between its locked position and its open position. In FIG. 5A, the lock switch is in its open position, and lock switch arm 192 is disengaged from notch 198. In FIG. 5B, the lock switch is in its closed position, and lock switch arm 192 is engaged with notch 198. As noted, the lock switch mechanism 126 may be coupled to the deadbolt mechanism 120 so that the switch is moved to its locked position when the deadbolt is extended.

Figure 6:
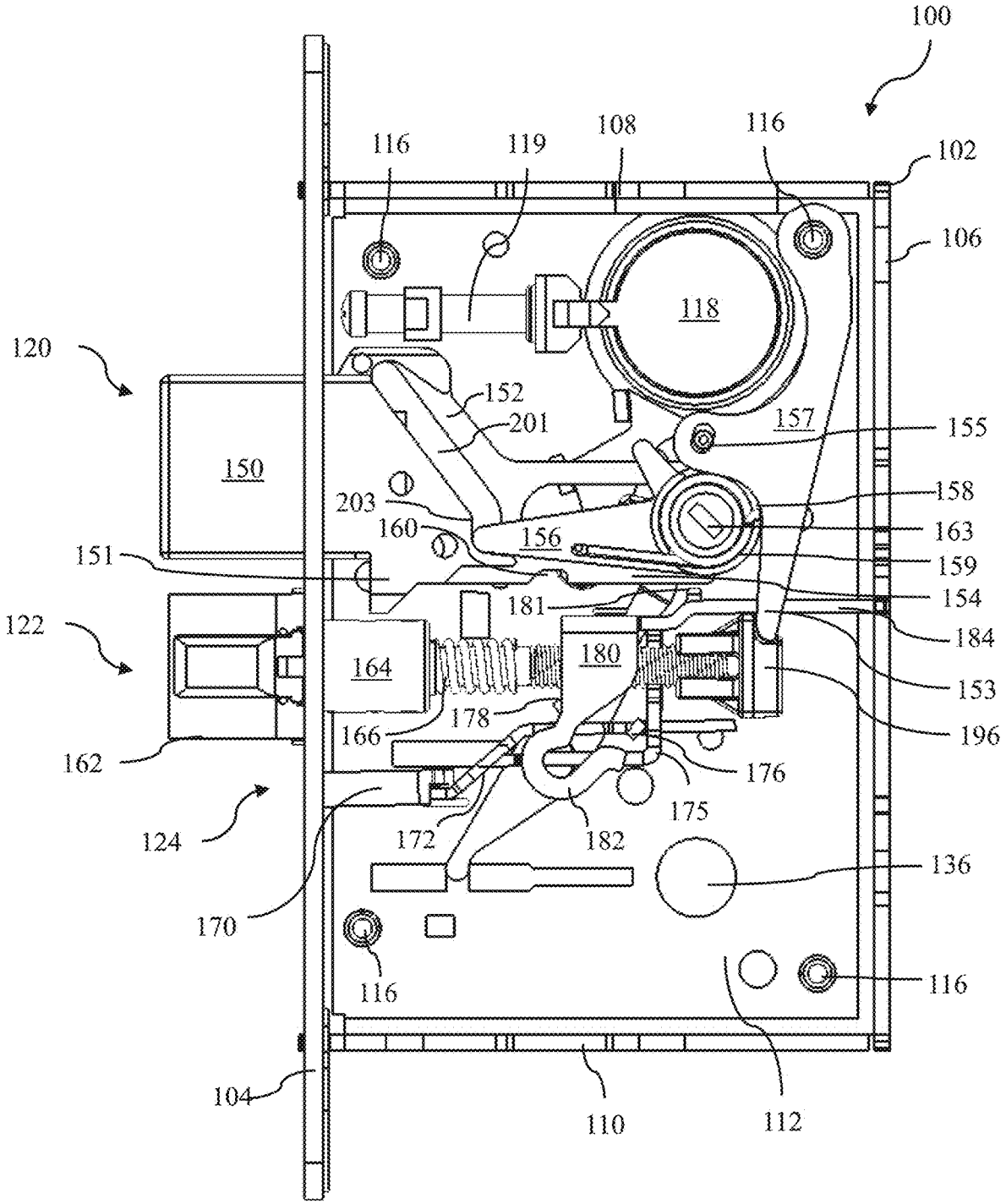
FIG. 6 illustrates a side view of a latch assembly according to another embodiment with a deadbolt in an extended position.

FIG. 6 illustrates another embodiment of a latch assembly 100. As shown in FIG. 6, the deadbolt mechanism 120 is in the extended position and the guard lever 180 is in the secure position. The relative positions of the deadbolt mechanism 120, latch bolt 122, and auxiliary bolt 124 as shown in FIG. 6 may occur when a door including the latch assembly is secure, for example, when the door is closed. In this arrangement, the deadbolt mechanism 120 is in the extended position, with deadbolt arm 156 fully rotated such that the apex of the arm is in the lower slot 203 of slide mechanism 152 to prevent movement of the deadbolt toward the retracted position. Guard lever 180 is in a secure position caused by auxiliary bolt 124 being in a retracted position and therefore causing auxiliary bolt arm 172 to contact lower guard lever leg 182 and force the guard lever 180 down (i.e., toward the secure position). In the secure position, sear 181 (constructed and configured here as a rigid sear on a guard lever arm 184) is in a position away from lower deadbolt leg 154, such that the sear 181 does not contact catch 160. Thus, the deadbolt mechanism 120 is free to move toward an extended deadbolt position, and is urged toward the extended position by the urging member 159 through the deadbolt arm 156 and slide mechanism 152. Latch bolt 122 is in the extended latch position, and urged toward the extended latch position by a latch biasing member 166. Deadbolt mechanism 120 includes a deadlocking tab 151 constructed and arranged to prevent the latch bolt 122 from retracting when the deadbolt mechanism 120 is in the extended deadbolt position. In the present embodiment, deadlocking tab 151 in configured to abut and resist full retraction of the latch bolt head 162 if the latch bolt head is moved toward the retracted position.

In the present embodiment, the guard lever lower leg 182 is configured as a hook positioned around first tab 176. In this embodiment, the hook 182 acts to reliably move the guard lever arm 184 between the upper free position (see FIG. 9A) and the lower secure position (see FIG. 9B). As the auxiliary bolt 124 extends, the guard lever arm 184 is moved toward the free position by the hook 182 as it engages with first tab 176 of the auxiliary arm 172 to force the guard lever 180 up from the secure position to the free position. In the free position, the sear 181 engages the catch 160 to prevent the deadbolt mechanism 120 from extending. As the auxiliary bolt 124 retracts, the guard lever arm 184 is moved to the secure position by the hook 182 as it engages with first tab 176 and auxiliary arm 172 to force the guard lever 180 down from the free position to the secure position. In the secure position, the sear 181 is released from the catch 160, thereby allowing the deadbolt mechanism 120 to extend. According to the present arrangement, the hook 182 may allow the guard lever arm 184 to be moved between the secure and free positions more reliably and consistently than an arrangement with no hook. For example, the guard lever 180 may be moved by hook 182 contacting both the first tab 176, and auxiliary arm 172, thereby improving reliability of the movement between the free and secure positions. Similarly, the hook 182 may cause first tab 176 to move the guard lever 180 toward the secure position as the auxiliary bolt extends, thereby preventing contact between the sear 181 and deadbolt lower leg 154 as the deadbolt is retracted and reducing the chance of a jam. While in the present embodiment the guard lever 180 is constructed and configured as a hook, and suitable shape may be employed that allows the guard lever 180 to be reliably moved between the free and secure positions by the auxiliary arm 172 and/or one or more tabs.

As described previously and in the present embodiment, the lower slot 203 in combination with the deadbolt arm 156 prevents the deadbolt head 150 from being moved toward the retracted position without actuation from a handle or locking device that would rotate the deadbolt arm 156 out of lower slot 203. In some embodiments, a handle may be installed in hole 136 that actuates latch bolt 122 and specifically latch bolt end 196. Latch bolt end 196 contacts deadbolt backstop 157 when the deadbolt mechanism 120 is in the extended position. When the handle or locking device is actuated, the latch bolt end 196 may be moved to rotated deadbolt backstop 157 via lower leg 153, thereby rotating deadbolt arm 156 via pin 155 to retract deadbolt mechanism 120. According to this embodiment, the handle or locking device may retract the latch bolt 122 and deadbolt mechanism 120 simultaneously. Such an arrangement may be beneficial in order to simply operation of the latch assembly 100 from an interior side of a door, while still providing the enhanced security from the automatic deadbolt extension and deadlocking when the door is closed.

In the embodiment shown in FIG. 6, the deadbolt mechanism 120 includes a deadbolt biasing member 159 configured as a torsion spring located on a deadbolt arm 156. Such an arrangement may be beneficial to reduce the occupied space of a chassis 102 of the latch assembly 100, thereby freeing space for other possible components. According to the present embodiment, the latch assembly 100 includes a lock adjustment device 119. The lock cylinder adjustment device 119 is constructed and configured to secure a lock mechanism, such as a key-operated cylinder lock, an electromechanical lock, or other suitable locking device in space 118. In some embodiments, the lock adjustment device is accessible from front plate 104 of the chassis 102. In such an arrangement, the lock adjustment device cannot be manipulated when the door is closed.

In the embodiment depicted in FIG. 6, the latch assembly 100 includes an auxiliary bolt guide 175. Auxiliary bolt guide 175 transmits force from the auxiliary biasing member (not shown in the figure) to urge auxiliary bolt 124 toward the extended position. In some embodiments, auxiliary biasing member is configured as a compression spring located around the auxiliary guide 175. The auxiliary biasing member is constructed and arranged to contact the auxiliary bolt guide 175 and auxiliary bolt arm 172. Thus, a compressive force is created between the auxiliary bolt guide 175 and the auxiliary arm 172 which urges the auxiliary bolt 124 toward an extended auxiliary position. The auxiliary bolt guide 175 may also guide the auxiliary bolt between its extended and retracted positions by sufficiently contacting the auxiliary bolt arm 172 to prevent movement not toward its extended or retracted positions (e.g, lateral movement). According to the present embodiment, the auxiliary bolt guide 175 may be fixed to the chassis 102, such that the auxiliary biasing member can urge the auxiliary bolt toward the extended position by contacting the auxiliary bolt guide 175 and auxiliary bolt leg 172.

As shown in FIG. 6, the deadbolt head 150 may also include a deadlocking tab 151. The deadlocking tab 151 is configured to engage a latch bolt head 162 to prevent the deadbolt from extending when the latch bolt is in a retracted latch position. Similarly, the deadlocking tab 151 prevents the latch bolt from retracting when the deadbolt head 150 is in an extended position. Accordingly, the deadbolt is first retracted by deadbolt arm 156 in order for the latch bolt head 162 to retract. Without wishing to be bound by theory, such an arrangement may increase security of an adjoined door by increasing the number of locking points along the door frame, thereby increasing locking strength of the latch assembly 100. In the present embodiment, the latch bolt head 162 is first extended in order for the deadbolt mechanism 120 to extend. Such an arrangement may prevent the deadbolt from extending prior to the complete closure of the door when the latch bolt head 162 is able to extend into a door frame pocket. By preventing the deadbolt mechanism 120 from extending prior to the latch bolt head 162 entering the door frame pocket, the deadbolt head 150 may be sufficiently aligned with the door frame pocket such that the deadbolt head avoids impacting the door frame which may cause a jam or other undesirable effects (e.g, damage to the door frame).

Figure 7:
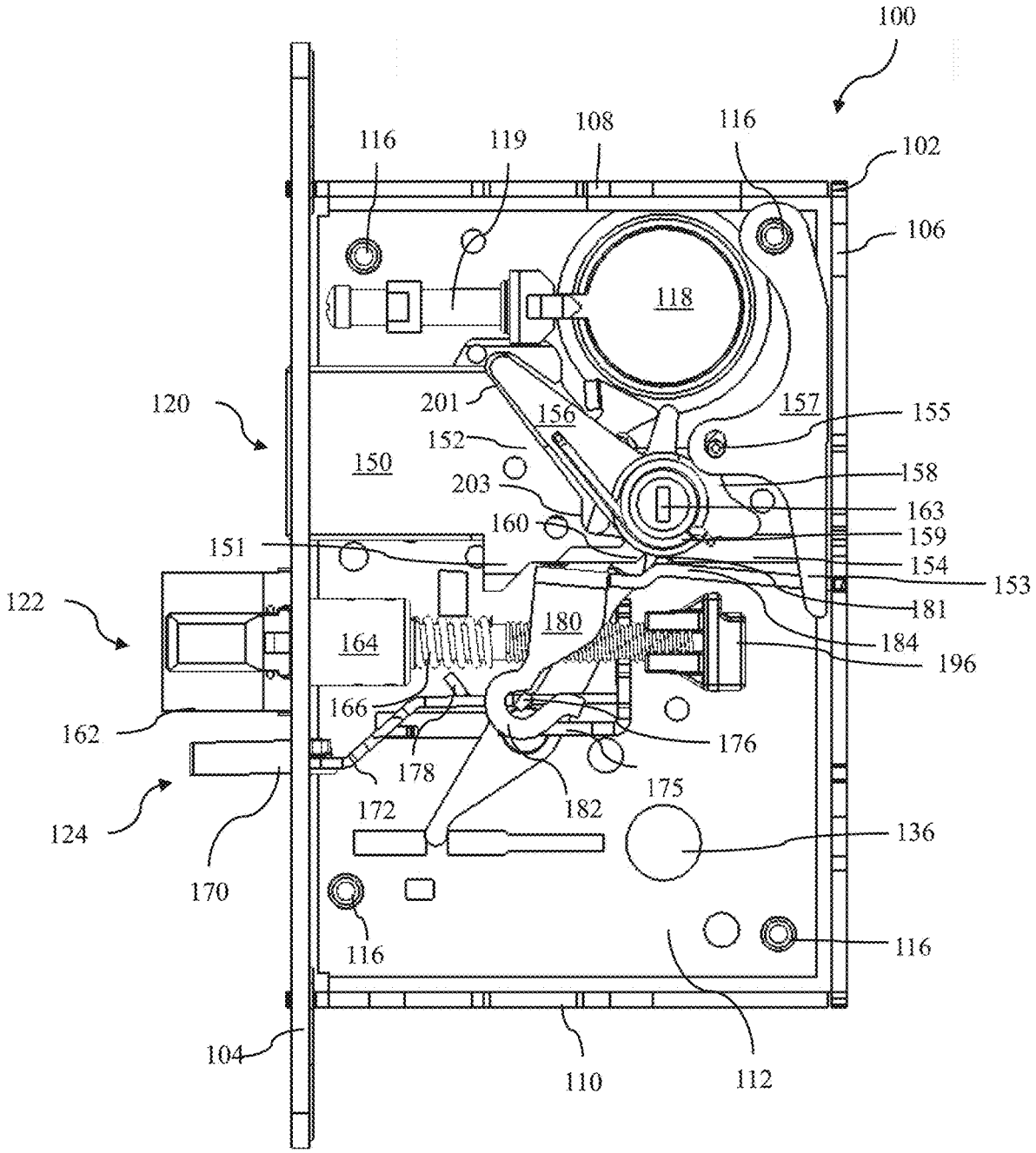
FIG. 7 illustrates a side view of the latch assembly of FIG. 6 with the deadbolt in a retracted position.

FIG. 7 illustrates the embodiment of the latch assembly 100 of FIG. 6 with the deadbolt mechanism 120 in the retracted position and the guard lever in the free position. The relative positions of the deadbolt mechanism 120, latch bolt 122, and auxiliary bolt 124 as shown in FIG. 7 may occur when an associated door is unsecure, for example, when the door is open. In this arrangement, the deadbolt mechanism 120 is in the retracted position, with deadbolt arm 156 rotated into angled cam slot 201 of slide mechanism 152 and the deadbolt head 150 sufficiently contained within the chassis 102. Guard lever 180 is in a free position caused by auxiliary bolt 124 being in an extended position and therefore causing first tab 176 to contact lower guard lever leg 182 and force the guard lever 180 up (i.e. toward the free position). In the free position, sear 181 on a guard lever arm 184 is close proximity with lower deadbolt leg 154, such that the sear 181 contacts catch 160. Thus, the deadbolt mechanism 120 is prevented from moving toward the extended position, and the sear 181 resists urging force from the deadbolt biasing member 159.

Figure 8A:
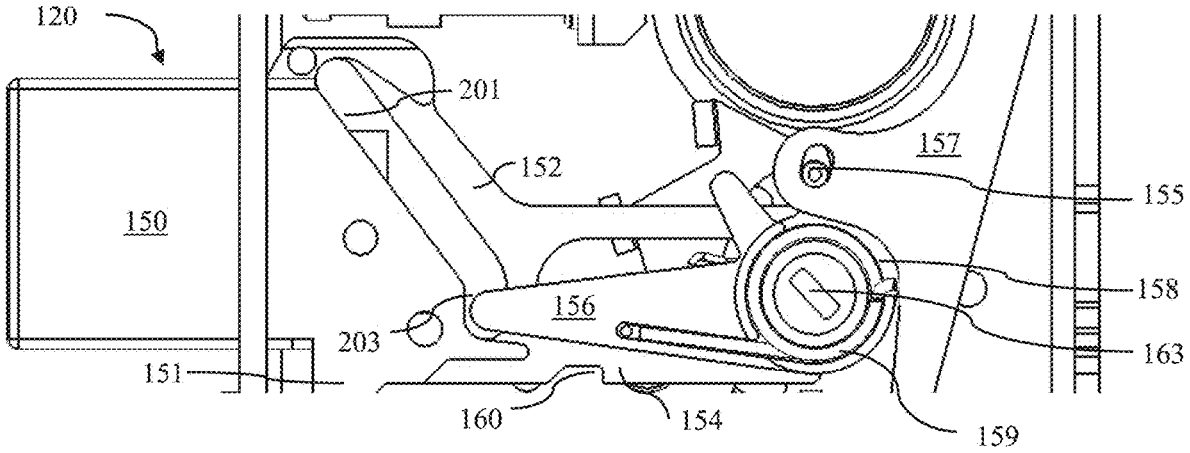
FIGS. 8A-8B illustrate detailed views of a deadbolt within the latch assembly of FIGS. 6-7.
Figure 8B:
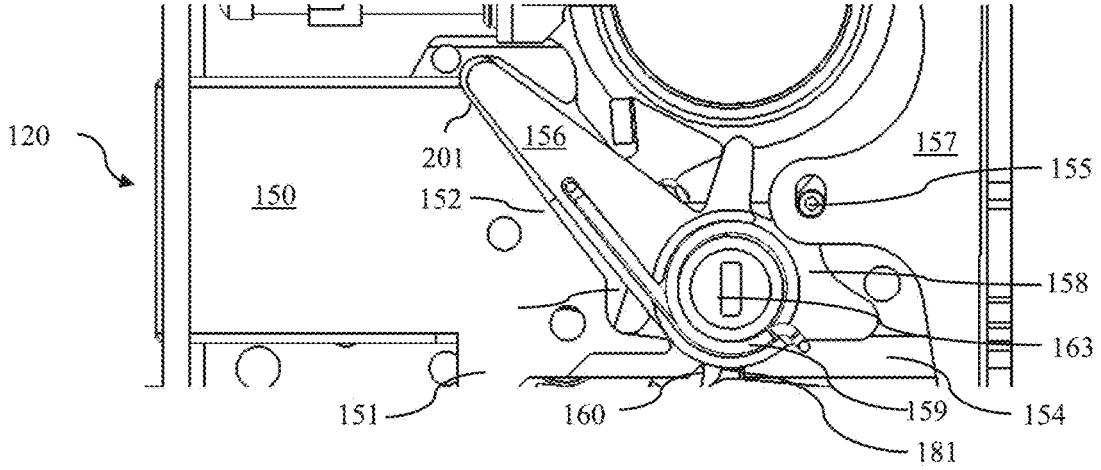

FIGS. 8A-8B further illustrate operation of the deadbolt mechanism 120 of FIGS. 6-7 to move the deadbolt head 150 relative to the chassis between an extended deadbolt position and a retracted deadbolt position. In FIG. 8A, the deadbolt head 150 is fully extended and deadbolt arm 156 is rotated to an aligned orientation with respect to the deadbolt head 150 and engaged with the lower slot 203 of the slide mechanism 152. In FIG. 8B, the deadbolt is fully retracted as the deadbolt arm has been fully rotated to engage cam slot 201 of an obliquely-angled portion of the slide mechanism 152. The interaction between the slide mechanism 152 and the deadbolt arm 156 is also shown. For example, as the deadbolt mechanism moves from a retracted to an extended position, the arm 156 moves along the angled portion of the slide mechanism 152. As shown in FIG. 8A, when in the deadbolt head 150 is in extended position, the protrusion of arm 156 is at a position in the lower slot 203 of the slide mechanism 152 such that an inward force applied to deadbolt head 150 will not result in the protrusion of arm 156 moving along lower slot 203, thereby preventing such force from causing the deadbolt mechanism 120 to move to a retracted position.

Figure 9A:
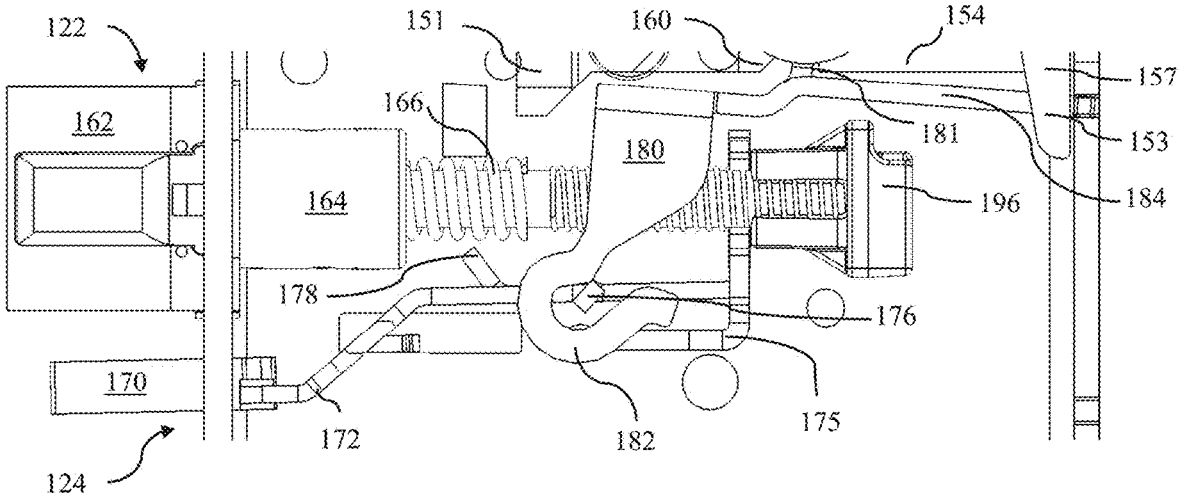
FIGS. 9A-9B illustrate detailed views of a latch bolt and an auxiliary bolt within the latch assembly of FIGS. 6-7.
Figure 9B:
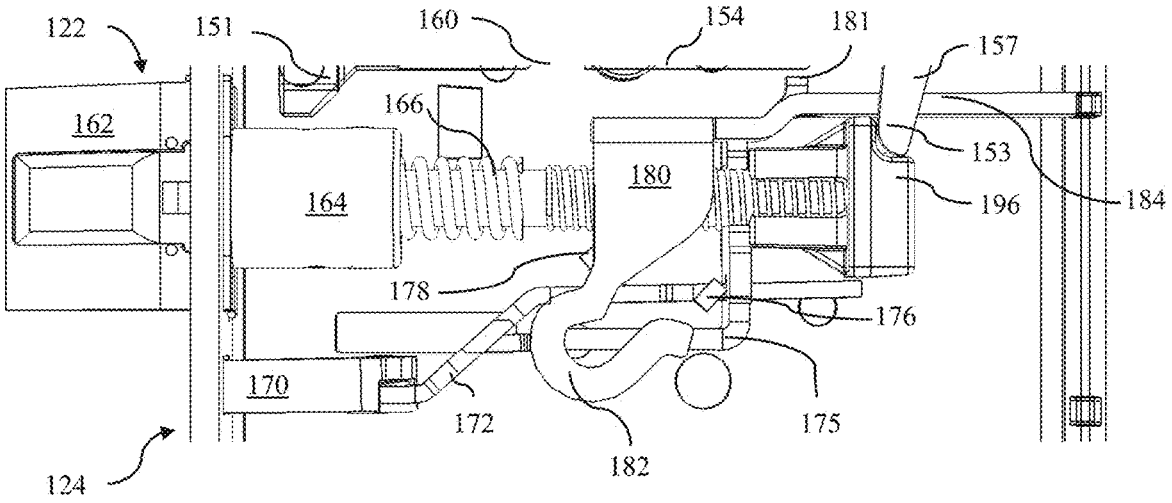

FIGS. 9A-9B further illustrate movement of the auxiliary bolt 124 of FIGS. 6-7 relative to the chassis between an extended and a retracted auxiliary position. In FIG. 9A, the latch bolt 122 and the auxiliary bolt 124 are fully extended. Guard lever 180 is in its free position as first tab 176 contacts and lifts lower leg 182 (i.e., moves lower leg 182 toward the free position). With the guard lever 180 in its free (i.e., upper) position, sear 181 engages a catch 160 on lower deadbolt leg 154, thereby preventing extension of the deadbolt head 150. In FIG. 9B, the auxiliary bolt 124 is fully retracted while the latch bolt 122 is still fully extended. This is the condition when the door is closed, the latch head 162 of the latch bolt 122 extends under the force of latch biasing member 166 into a pocket in the door frame but no pocket is provided in the door frame for the tongue 170 of the auxiliary bolt 124, and thus the auxiliary bolt 124 does not extend. With latch bolt 122 extended and the auxiliary bolt 124 not extended, the guard lever 180 is in its secure position, with sear 181 disengaged from catch 160 on lower deadbolt leg 154. With the sear 181 disengaged from the catch 160, the deadbolt head 150 is able to automatically extended by action of the deadbolt biasing member 159 acting on the deadbolt backstop 157, which, in turn, due to the coupling of the deadbolt backstop 157 to the deadbolt arm 156 by the peg 155, causes the deadbolt arm 156 to rotate and thereby extend the deadbolt head 150. Thus, when the door is closed, the deadbolt automatically extends into the locked (i.e., extended) position.

Figure 10:
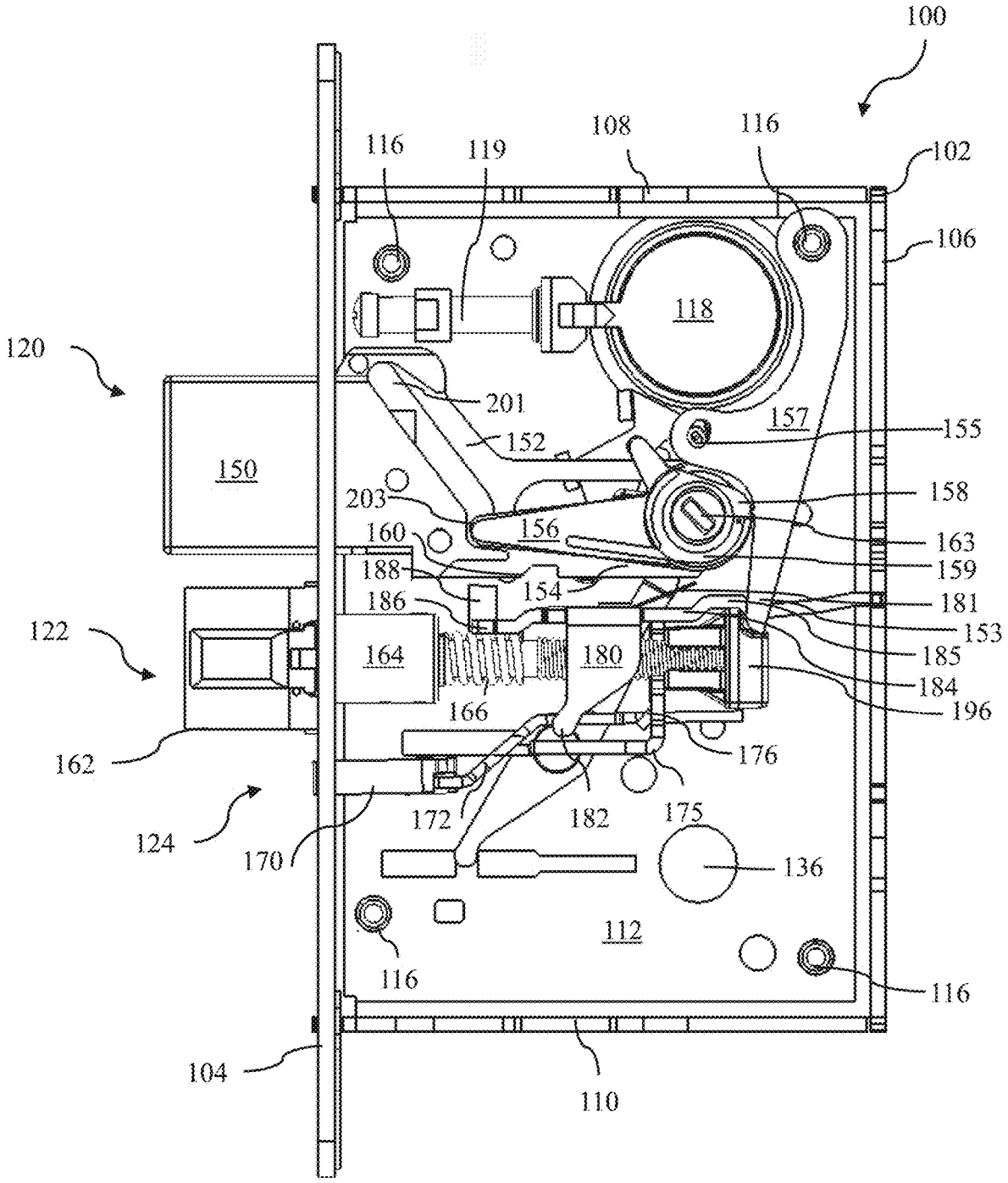
FIG. 10 illustrates a side view of a latch assembly according to yet another embodiment with a deadbolt in an extended position.

FIG. 10 illustrates yet another embodiment of a latch assembly 100 with the deadbolt head 150 in the extended position and the guard lever 180 in the secure position. The relative positions of the deadbolt mechanism 120, latch bolt 122, and auxiliary bolt 124 as shown in FIG. 10 may occur when an associated door is secure, for example, when the door is closed. In this position, deadbolt arm 156 is fully rotated into lower slot 203 of slide mechanism 152. In this embodiment, deadbolt arm 156 is urged into lower slot 203 by deadbolt biasing member 159 constructed and configured as a torsion spring. Deadbolt mechanism 120 is able to extend as guard lever 180 is in the lower (i.e. secure) position. When the guard lever 180 is in the lower position, the sear 181 (constructed and configured here as flexible projection attached to guard lever 180), is removed from contacting catch 160, which would prevent deadbolt head 150 from moving toward the extended position. Guard lever 180 is moved to the secure position by auxiliary bolt 124 when the auxiliary bolt is in a retracted position. Auxiliary bolt 124 includes tongue 170, which is constructed and arranged with at least one inclined side to cause the auxiliary bolt to retract when tongue 170 strikes a door frame. The auxiliary bolt 124 also includes auxiliary bolt arm 172, which further includes first tab 176. As the auxiliary bolt is retracted by tongue 170, auxiliary bolt arm 172 contacts lower guard leg 182, thereby forcing the guard lever 180 down (i.e., toward the secure position). Auxiliary bolt 124 also includes auxiliary bolt guide 175 and auxiliary biasing member (not shown in the figure) located on the auxiliary bolt guide 175. Auxiliary bolt guide 175 is connected to the auxiliary biasing member in order to urge the auxiliary bolt toward the extended position. In the present embodiment, the auxiliary biasing member is located on the auxiliary bolt guide, and the auxiliary bolt guide is rigidly mounted in chassis 102, such that the urging member can urge auxiliary bolt 124 toward the extended position.

As shown in FIG. 10, guard lever arm 184 includes a stopping end 186 constructed and configured to prevent the retraction of latch bolt head 162 when the guard lever 180 is in the secure position. In certain embodiments, the pivoting movement of the guard lever arm 184 is controlled and limited by an extension of the guard lever near the stopping end extending laterally into a slot 188 formed in one or both of side plates 112. When the guard lever 180 is in its secure position, the stopping end 186 of the guard lever arm acts to prevent the latch bolt 122 from moving to its retracted position by contacting the latch bolt cylinder 164 and thereby blocking further retraction of the latch bolt 122. In some cases, it may be beneficial for the guard lever 180 to be moved to the free position when the handle is actuated, such that the stopping end 186 is moved away from the latch bolt cylinder 164 such that the latch bolt 122 can be retracted. Accordingly, the guard lever arm 184 includes a guard inclined section 185 constructed and arranged to abut the end 196 of the latch bolt 122. When the end 196 is moved by a door handle, it abuts the guard inclined section 185 and moves the guard lever 180 toward the free position. As the guard lever 180 is moved toward the free position the stopping end 186 is lifted (i.e. moved toward the free position), such that the latch bolt 122 can retract without contacting the stopping end 186. In such an arrangement, the guard lever 180 can be moved toward the free position and the latch bolt 122 can be retracted with a single actuation of the handle.

In some cases, it may be beneficial to prevent the deadbolt mechanism 120 from extended without using a deadlocking tab as described previously. Accordingly, the stopping end 186 may also prevent the deadbolt mechanism 120 from extending. In the case where guard lever 180 is in the free position, stopping end 186 is elevated above latch bolt cylinder 164 (see FIG. 3A). If the latch bolt 122 is in the retracted position, latch bolt cylinder 164 is moved to a retracted position, below stopping end 186 near slot 188. In this position, the guard lever 180 is prevented from moving to the secure position as stopping end 186 contacts an upper portion of latch bolt cylinder 164. Thus, the guard lever 180 remains in the free position even if auxiliary bolt 124 is retracted. According to the present embodiment, auxiliary bolt arm 172 is sufficiently below guard lever 180, such that when the stopping end 186 abuts on the latch bolt cylinder 164 and prevents the guard lever 180 from moving to the secure position the auxiliary arm 172 is unable to contact and force guard lever 180 down (i.e. toward the secure position). Such an arrangement may prevent damage to latch assembly 100 in the case the latch bolt 122 is in the retracted position and force is applied to tongue 170 which may cause the auxiliary bolt 124 to retract.

In some embodiments, the latch assembly includes a hole 136 configured and arranged to attach a lever hub and/or a handle. The handle may be configured to actuate an end 196 of the latch bolt 122. End 196 may also contact deadbolt backstop 157 via lower leg 153. When the handle is actuated, the latch bolt 122 and latch bolt end 196 may move toward the retracted latch position. Accordingly, the deadbolt backstop 157 may be pivoted by the latch bolt end 196, which may cause deadbolt arm 156 to be rotated by pin 155 which links the deadbolt backstop 157 and deadbolt arm 157. As deadbolt arm 156 is rotated by deadbolt backstop 157, deadbolt mechanism 120 is moved toward the retracted position by sliding mechanism 152. Thus, when an attached handle is actuated, the latch bolt 122 and deadbolt mechanism 120 may be moved toward their respective retracted positions simultaneously.

Figure 11:
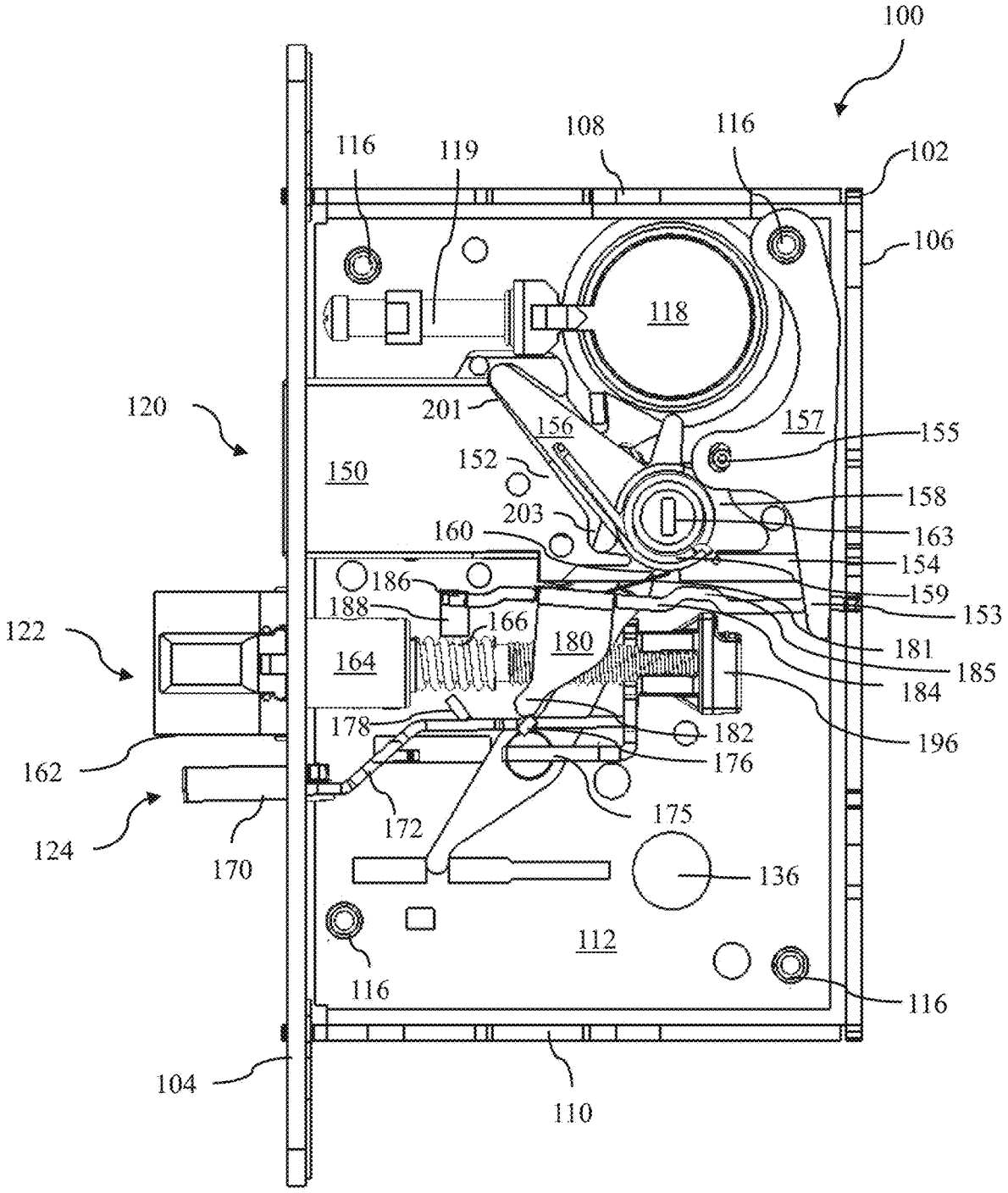
FIG. 11 illustrates a side view of the latch assembly of FIG. 10 with the deadbolt in a retracted position.

FIG. 11 illustrates the embodiment of the latch assembly 100 of FIG. 10 with the deadbolt head 150 in the retracted position and the guard lever 180 in the free position. The relative positions of the deadbolt mechanism 120, latch bolt 122, and auxiliary bolt 124 as shown in FIG. 11 may occur when an associated door is unsecure, for example, when the door is open. In this position, deadbolt arm 156 is rotated into an angled slot 201 of slide mechanism 152. Deadbolt mechanism 120 is unable to extend as guard lever 180 is in the upper (i.e. free) position. When the guard lever 180 is in the free position, the sear 181 (constructed and configured here as a flexible projection attached to guard lever 180) contacts catch 160 which prevents deadbolt head 150 from moving toward the extended position and resists urging force from the deadbolt biasing member 159. Guard lever 180 is moved to the free position by auxiliary bolt 124 when the auxiliary bolt is in an extended auxiliary position. Auxiliary bolt 124 also includes auxiliary bolt guide 175 and auxiliary biasing member (not shown in the figure). Auxiliary bolt guide 175 is connected to the auxiliary biasing member in order to urge the auxiliary bolt toward the extended position. In the present embodiment, the auxiliary biasing member is located on the auxiliary bolt guide 175, and the auxiliary bolt guide 175 is rigidly mounted in chassis 102, such that the urging member can urge auxiliary bolt 124 toward the extended position. The auxiliary bolt 124 also includes auxiliary bolt arm 172, which further includes first tab 176. As the auxiliary bolt is extended by auxiliary biasing member, first tab 176 contacts lower guard leg 182, thereby forcing the guard lever 180 up (i.e., toward the free position).

Figure 12C:
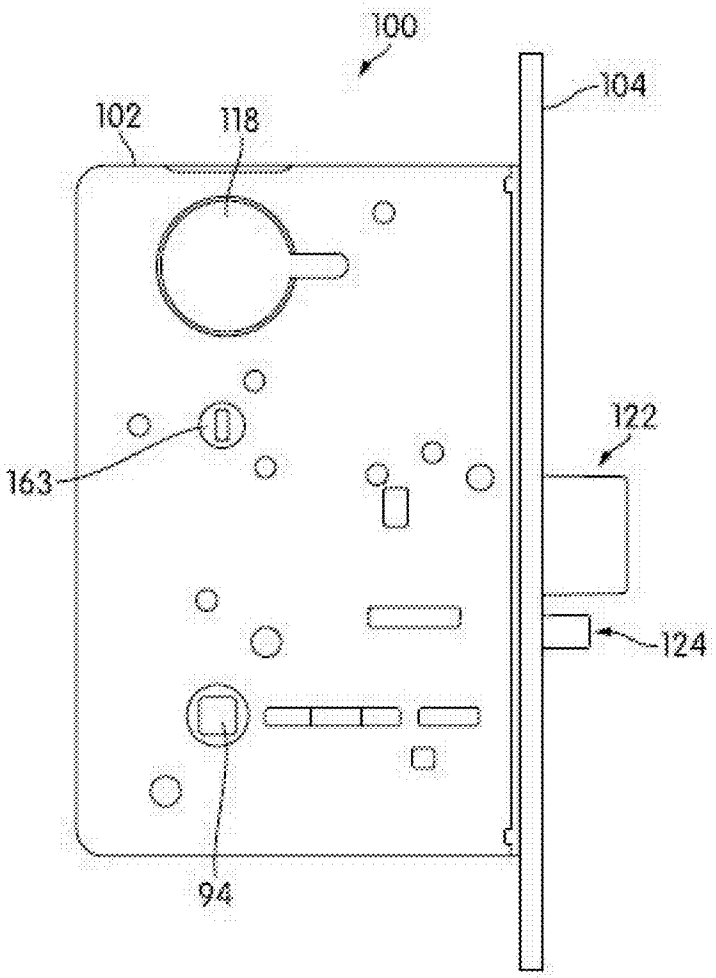
FIGS. 12A-12C illustrate views of embodiments of front, rear, and side plates respectively of a latch assembly.
Figure 12B:
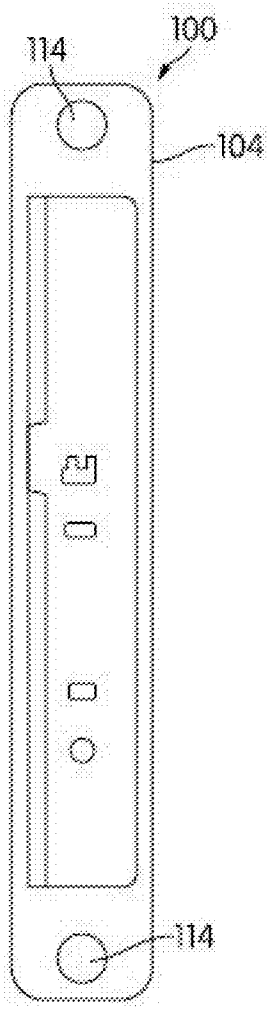
Figure 12A:
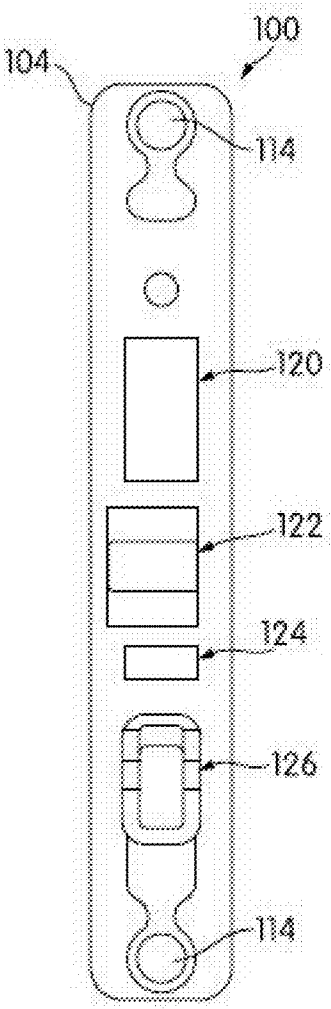

FIGS. 12A-12C further illustrate one embodiment of the chassis of the latch assembly 100. FIG. 12A shows a front view of front plate 104. Front plate 104 includes one or more screw holes 114 for mounting latch assembly 100 to a door. The front plate 104 further include cutouts to accommodate the deadbolt mechanism 120, latch bolt 122, auxiliary bolt 124 and allow their movement between extended and retracted positions. FIG. 12B shows a front view of rear plate 106. Rear plate 106 includes one or more screw holes 114 for mounting latch assembly 100 to a door. FIG. 12C shows a side view of the bottom one of the side plates 112 with latch bolt 122 and auxiliary bolt 124 in their respective extended positions. The side plates 112 include one or more cutouts for mounting the components in the previously described embodiments, in addition to traditional door hardware components like handles, locking devices, etc.

Figure 13B:
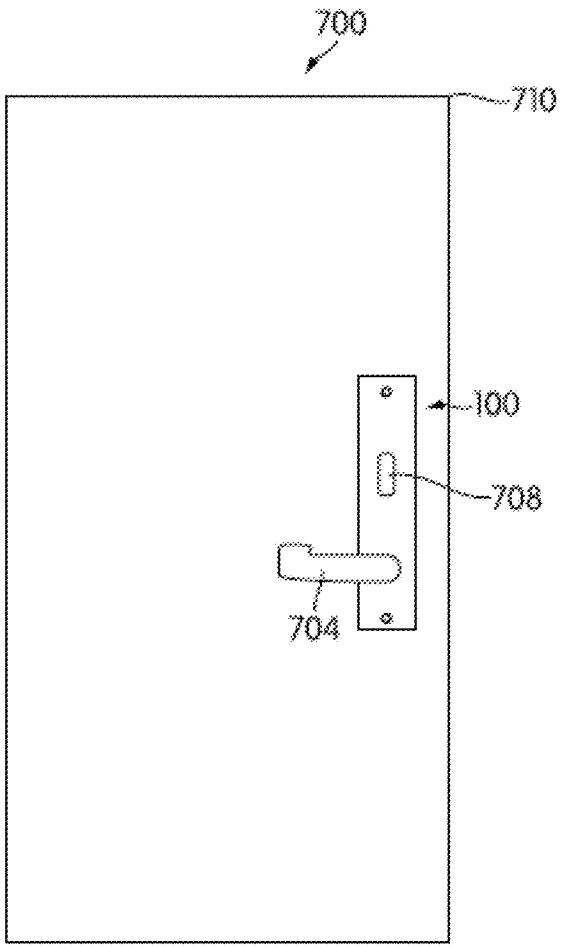
FIGS. 13A-13B illustrate views of a door including a latch assembly.
Figure 13A:
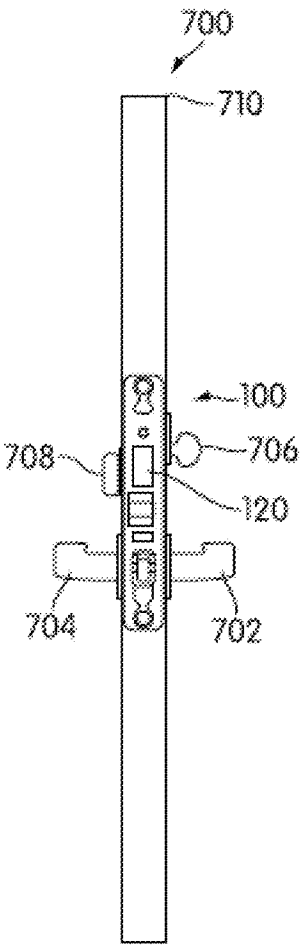

FIGS. 13A-13B illustrate one embodiment of a door system including a latch assembly 100. As shown, a door system 700 includes a door 710 having a latch assembly such as latch assembly 100 installed thereon. As fully installed, the door system may further include an outside door handle 702 and an inside door handle 704, each operable to open the door when unlocked. In some embodiments, inside door handle 704 may also be operable to open the door when it is locked. In some embodiments, a key 706 may be used to engage a key and core assembly which can lock or unlock the door system 700. In some embodiments, latch assembly 100 may be installed on a door by an end user. A thumb knob 708 is configured to operate the deadbolt mechanism 120 to selectively extend or retract the deadbolt head 150. In one embodiment, the knob 708 is coupled to slot 163 of the thumb turn 158. The latch assembly 100 is configured to automatically extend the deadbolt mechanism when the door 710 is closed as described above.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A latch assembly for a door including:

a chassis;

a latch bolt supported by the chassis and configured to move relative to the chassis between a retracted latch position and an extended latch position;

an auxiliary bolt supported by the chassis and configured to move relative to the chassis between a retracted auxiliary position and an extended auxiliary position;

a deadbolt supported by the chassis and configured to move relative to the chassis between a retracted deadbolt position and an extended deadbolt position, the deadbolt including a lower deadbolt leg having a catch;

a guard lever having a free position and a secure position, wherein when the auxiliary bolt is in the extended auxiliary position the guard lever is in the free position allowing the latch bolt to move between the extended latch position and retracted latch position, and when both the auxiliary bolt is in the retracted auxiliary position and the latch bolt is in the extended latch position, the guard lever is in the secure position preventing movement of the latch bolt to the retracted latch position; and a sear connected to a top of the guard lever, the sear being configured to engage with the catch of the lower deadbolt leg when the guard lever is in the free position, thereby maintaining the deadbolt in the retracted deadbolt position, and the sear being configured to release from the catch of the lower deadbolt leg when the guard lever is in the secure position, thereby permitting the deadbolt to move to the extended deadbolt position.

2. The latch assembly of claim 1, wherein the guard lever includes a lower guard leg constructed as a hook.

3. The latch assembly of claim 1, further comprising a deadbolt biasing member constructed and arranged to urge the deadbolt toward the extended deadbolt position.

4. The latch assembly of claim 3, wherein the deadbolt biasing member is configured as a torsion spring.

5. The latch assembly of claim 1, wherein the sear is constructed and arranged to flex relative to the guard lever when the deadbolt moves toward the retracted deadbolt position.

6. The latch assembly of claim 1, wherein the sear is constructed and arranged to remain stationary relative to the guard lever when the deadbolt moves toward the retracted deadbolt position.

7. The latch assembly of claim 1, further comprising a latch biasing member constructed and arranged to urge the latch bolt toward the extended latch position.

8. The latch assembly of claim 1, further comprising an auxiliary biasing member constructed and arranged to urge the auxiliary bolt toward the extended auxiliary position.

9. The latch assembly of claim 1, wherein the guard lever includes a guard biasing member constructed and arranged to urge the guard lever toward the secure position.

10. The latch assembly of claim 1, wherein the guard lever includes a guard biasing member constructed and arranged to urge the guard lever toward the free position.

11. The latch assembly of claim 1, wherein the deadbolt further includes a deadlocking tab constructed and arranged to prevent the latch bolt from moving toward the retracted latch position when the deadbolt is in the extended deadbolt position.

12. The latch assembly of claim 11, wherein the deadlocking tab is further constructed and arranged to prevent the deadbolt from moving toward the extended deadbolt position when the latch bolt is in the retracted latch position.

13. The latch assembly of claim 1, wherein the guard lever includes a stopping end constructed and arranged to prevent the latch bolt from moving toward the retracted latch position when the guard lever is in the secure position.

14. The latch assembly of claim 13, wherein the stopping end is further constructed and arranged to prevent the guard lever from moving toward the secure position when the latch bolt is in the retracted latch position.

15. The latch assembly of claim 1, further comprising a lever hub constructed and arranged to receive a door handle, wherein the lever hub is actuable by the door handle, and wherein actuation of the lever hub moves the deadbolt toward the retracted deadbolt position and moves the latch bolt toward the retracted latch position.

16. The latch assembly of claim 15, wherein the lever hub is further constructed and arranged to move the guard lever, wherein actuation of the lever hub moves the guard lever toward a free position.

17. The latch assembly of claim 15, further comprising a lock switch constructed and arranged to be move between a locked switch position and an unlocked switch position, wherein the lock switch prevents actuation of the lever hub when in the locked switch position and allows actuation of the lever hub when in the unlocked switch position.

18. The latch assembly of claim 17, wherein the lock switch is actuable from a front plate of the chassis.

19. The latch assembly of claim 17, wherein the lock switch is further constructed and arranged to be moved between the locked switch position and unlocked switch position by the deadbolt.

20. A door system including:

a door;

a mortise lock, coupled to said door;

a first handle coupled to said door and to said mortise lock and operable to open said door;

a second handle coupled to said door and to said mortise lock and operable to open said door; and a key system coupled to said door and to said mortise lock, wherein the mortise lock includes the latch assembly of claim 1.

* * * * *